US006798139B2

(12) United States Patent
Ramaiah et al.

(10) Patent No.: US 6,798,139 B2
(45) Date of Patent: Sep. 28, 2004

(54) THREE ELECTRODE CERAMIC METAL HALIDE LAMP

(75) Inventors: Raghu Ramaiah, Euclid, OH (US); James T. Dakin, Shaker Heights, OH (US)

(73) Assignee: General Electric Company, Schenectady, NY (US)

( * ) Notice: Subject to any disclaimer, the term of this patent is extended or adjusted under 35 U.S.C. 154(b) by 11 days.

(21) Appl. No.: 10/179,695

(22) Filed: Jun. 25, 2002

(65) Prior Publication Data

US 2003/0234613 A1 Dec. 25, 2003

(51) Int. Cl.[7] ..... H01J 17/16; H01J 61/30

(52) U.S. Cl. ..... 313/634; 313/620; 313/621; 313/624

(58) Field of Search ..... 313/634, 631, 313/620, 621, 624

(56) References Cited

U.S. PATENT DOCUMENTS 5,424,609 A 6/1995 Geven et al.
5,698,984 A 12/1997 Little et al.
5,751,111 A 5/1998 Stoffels et al.
5,879,215 A 3/1999 Duffy et al.
5,994,839 A 11/1999 Yamamoto et al.
6,172,462 B1 1/2001 Gibson et al.
6,483,230 B1 * 11/2002 Oda et al. ..... 313/25
6,583,563 B1 * 6/2003 Venkataramani et al. ... 313/634

FOREIGN PATENT DOCUMENTS

WO WO 99/41761 8/1999

* cited by examiner

*Primary Examiner*—Nimeshkumar D. Patel
*Assistant Examiner*—Sumati Krishnan
(74) *Attorney, Agent, or Firm*—Fay, Sharpe, Fagan, Minnich & McKee, LLP

(57) ABSTRACT

A ceramic body (14) for a discharge vessel (12) includes a central barrel portion (60) and two end plus (64, 66), which close opposite ends of the barrel. Main electrode (32, 34) and an initiator electrode 50 are supplied with power via conductors in leg members (70, 76, 72). In one embodiment, a first electrode 32 and the initiator electrode are supplied with current through two separate leg members. In another embodiment, a dual electrode leg member is provided with two bores (124, 126).

9 Claims, 5 Drawing Sheets

THREE ELECTRODE CERAMIC METAL HALIDE LAMP

BACKGROUND OF THE INVENTION

The present invention relates generally to ceramic arc discharge lamps and more particularly to a cathode for a high watt ceramic metal halide lamp for use in combination with a non pulse-start ballast.

Discharge lamps produce light by ionizing a fill material, such as a mixture of metal halide and mercury in an inert gas, such as argon, with an arc passing between two electrodes. The electrodes and the fill material are sealed within a translucent or transparent discharge chamber, which maintains the pressure of the energized fill material and allows the emitted light to pass through. The fill material, also known as a "dose," emits a desired spectral energy distribution in response to being excited by the electric arc. For example, halides provide spectral energy distributions that offer a broad choice of light properties, including color temperatures, color rendering, and luminous efficiency.

Arc tube chambers composed of fused silica "quartz" are readily formed. However, the lifetime of such lamps is often limited by the loss of the metal portion of the metal halide fill (typically sodium) during lamp operation. Sodium ions diffuse through, or react with, the fused silica arc tube, resulting in a corresponding build-up of free halogen in the arc tube. Quartz arc tubes are relatively porous to sodium ions. During lamp operation, sodium passes from the hot plasma and through the arc tube wall to the cooler region between the arc tube and the outer jacket or envelope. The lost sodium is thus unavailable to the discharge and can no longer contribute its characteristic emission. The light output consequently diminishes and the color shifts from white toward blue. The arc becomes constricted and, particularly in a horizontally operated lamp, may bow against the arc tube wall and soften it. Also, loss of sodium causes the operating voltage of the lamp to increase and it may rise to the point where the arc can no longer be sustained, ending the life of the lamp.

Ceramic discharge lamp chambers were developed to operate at higher temperatures than quartz, i.e., above 950° C., for improved color temperature, color rendering, and luminous efficacies, while significantly reducing reaction with the fill material. U.S. Pat. Nos. 5,424,609; 5,698,984; and 5,751,111 provide examples of such arc tubes. While quartz arc tubes are limited to operating temperatures of around 950° C. to 1000° C., due to reaction of the halide fill with the quartz, ceramic alumina arc tubes are able capable of withstanding operating temperatures of 1000° C. to 1250° C. or higher. The higher operating temperatures provide better color rendering and high lamp efficiencies. Ceramic arc tubes are less porous to sodium ions than quartz tubes and thus retain the metal within the lamp Various techniques are available for fabricating the arc tubes, including casting forging, machining, and various powder processing methods, such as powder injection molding (PIM). In powder processing, a ceramic powder, such as alumina, is supported by a carrier fluid, such as a water-based solution, mixture of organic liquids, or molten polymers. The mixture can be made to emulate a liquid, a plastic, or a rigid solid, by controlling the type and amount of carrier and the ambient conditions (e.g., temperature).

One problem with such lamps is that the light output (lumen maintenance) decreases with time. To reduce the rate at which the light output decreases, the argon pressure within the lamp is increased. Since the breakdown voltage (the voltage necessary to initiate an arc) generally increases with pressure, the higher internal pressures require higher voltages for initiating the arc. To initiate the formation of an arc, ceramic metal vapor lamps are conventionally fitted with a ballast having an igniter. The igniter senses that the arc has not formed and generates voltage pulses which cause breakdown of the vapor and permit current flow between the two electrodes. The igniter then turns off. Typically, high voltage pulses in the 4–5 kV range are used in 1–2 microsecond pulses. Thus, high wattage (over 175 watts) ceramic metal halide lamps have generally been limited to use in igniter started lamps (so-called Pulse Arc Ballasts). However, such lamps make up only a small proportion of the commercially-produced lamps available. The large majority (over 90%) of ballasts produced for high wattage metal halide lamps are not fitted with igniters Instead, the ballast is fitted with a constant wattage autotransformer (CWA) circuit One way to initiate the discharge in a lamp without an igniter is to have a three electrode system The two main electrodes are spaced from each other by a suitable distance for maintaining an arc during operation of the lamp, typically 2–3 cm. The third electrode is closely spaced to one of the main electrodes, providing a much smaller gap which allows the breakdown to occur more readily. Once breakdown has occurred between the third electrode and the closely spaced main electrode, the voltage to the third electrode is switched off and the arc is readily generated between the two main electrodes. Ceramic discharge tubes, however, have not been amenable to 3 electrode systems. Quartz discharge tubes which use 3 electrode systems are formed by a quartz pinching process which cannot be used with the much more brittle ceramic material. Because ceramic material is brittle, new designs and processes are required to prevent cracking during discharge tube fabrication and lamp operation.

The present invention provides a ceramic discharge tube capable of accommodating three electrodes, which overcomes the above-referenced problems and others.

SUMMARY OF THE INVENTION

In an exemplary embodiment of the present invention, a discharge vessel is provided. The discharge vessel includes a body of a translucent ceramic material. The body includes a barrel portion and first and second end walls closing ends of the barrel portion to define an interior chamber. At least a first generally cylindrical tube extends from the first end wall and opens into the chamber A second generally cylindrical tube extends from the second end wall and opens into the chamber. The first and second cylindrical tubes each have a shoulder portion which provides a curved transition between the cylindrical tube and the end wall. A fill is contained in the body for creating a discharge. Electrodes are supported in the chamber. The electrodes include a first main electrode, a second main electrode, and an initiator electrode disposed a preselected distance from the first electrode. The first main electrode and the initiator electrode are electrically connected with first and second lead through disposed in at least the first cylindrical tube. The second main electrode is connected with a third lead through disposed in the second cylindrical tube.

In another exemplary embodiment of the present invention, a method of forming a discharge vessel is provided. The method includes forming a generally cylindrical barrel and first and second end plugs from a ceramic material The first and second end plugs each include an end wall and at least one tubular leg portion. At least one tubular leg portion is joined to the end wall by a shoulder portion which provides a curved transition between the leg portion and the end wall. The method further includes heating the barrel and the end plugs together to a sufficient temperature to join the end plugs to the barrel and form a translucent body thereof. Three electrodes are positioned in the body. Electrical connections are provided for the three electrodes through the leg members. A fill of a material suitable for creating a discharge is sealed in the body.

In another exemplary embodiment of the present invention, a method of forming a translucent ceramic arc tube is provided. The method includes forming a slurry of a ceramic powder and a liquid and introducing the slurry into a cavity of a mold. The mold is formed of a porous material which absorbs the liquid Liquid is absorbed from the slurry to form a body capable of being removed from the mold without breaking. The body is fired at a sufficient temperature to form an arc tube having a hollow barrel with leg members extending from the barrel. The leg members have a total of at least three bores for receiving electrical connections for first, second, and third electrodes therethrough One advantage of at least one embodiment of the present invention is that a ceramic metal vapor lamp is provided which operates at high internal pressures without an igniter.

Another advantage of at least one embodiment of the present invention is the provision of a high strength ceramic discharge vessel which is resistant to fracturing.

Still further advantages of the present invention will become apparent to those of ordinary skill in the art upon reading and understanding the following detailed description of the preferred embodiments.

DETAILED DESCRIPTION OF THE INVENTION

Figure 1:
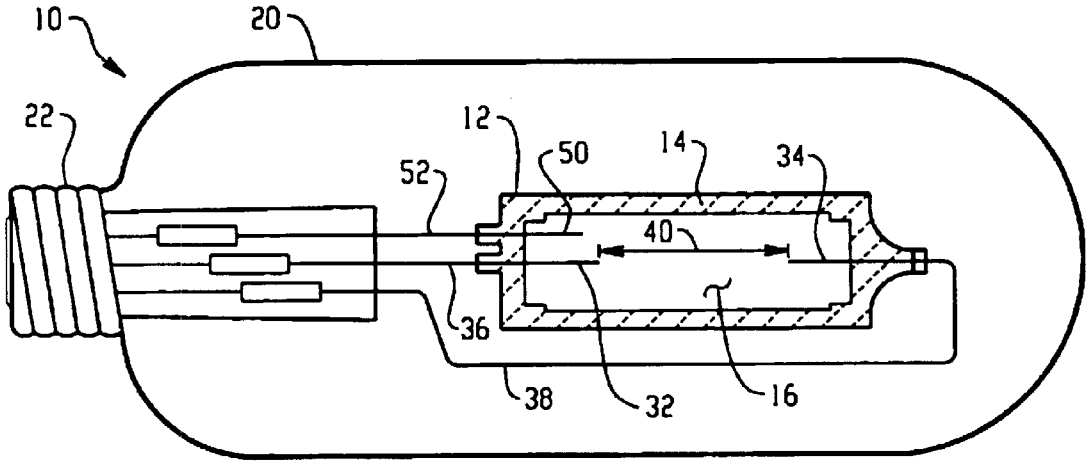
FIG. 1 is a side view of a lamp according to the present invention.

With reference to FIG. 1, a ceramic metal halide (CMH) lamp 10 is shown. The lamp includes a discharge vessel 12 comprising a high pressure envelope or arc tube 14, formed from a transparent or translucent material, such as polycrystalline alumina or sapphire (single crystal alumina), which encloses a chamber or discharge space 16. The discharge vessel is suited to use in high voltage lamps (those over about 175 watts) without a ballast having an initiator, and will be described with particular reference thereto although it is to be appreciated that the vessel 12 is also suited to use in other lamps.

The discharge space 16 contains a fill of an ionizable gas mixture such as metal halide and inert gas mixture. Suitable metal halide fills include at least one metal halide, such as sodium iodide, thalium iodide, or dysprosium iodide, in addition to mercury and a rare gas, such as Argon or Xenon. Other suitable fills for initiating and sustaining an arc discharge known in the art are also contemplated The discharge vessel is enclosed in an outer envelope 20 of glass or other suitable transparent or translucent material, which is closed by a lamp cap 22 at one end First and second main internal electrodes 32, 34, which may be formed from tungsten, extend into the discharge space 16. As shown in FIG. 1, the main electrodes are connected to conductors 36, 38, formed from molybdenum and niobium sections. The connectors electrically connect the electrodes to a power supply (not shown) by first and second electrical contact forming parts of the cap 22 It will be appreciated that other known electrode materials may alternatively be used. The electrodes 32, 34 are spaced by a gap 40 of about 2–3 centimeters. A discharge forms between the ends of the electrodes 32, 34 when a voltage is applied across the electrodes.

A third electrode or initiator electrode 50 extends into the discharge space parallel with the first electrode 32. The third electrode is formed from tungsten, or other suitable electrode material, and is closely spaced to the first electrode 32 (e.g., by about 1–2 millimeters). A conductor 52 electrically connects the electrode 50 with a source of power for generating a voltage between the first and third electrodes.

Figure 2:
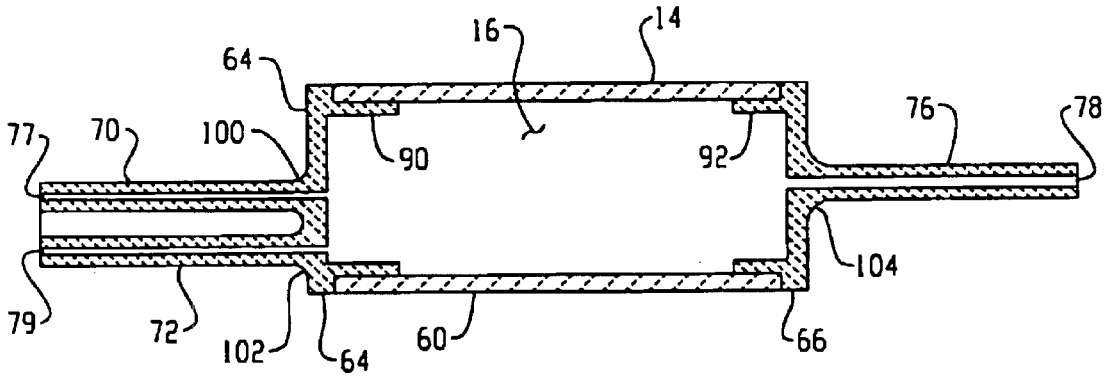
FIG. 2 is an enlarged side sectional view of the ceramic discharge vessel of FIG. 1.
Figure 3:
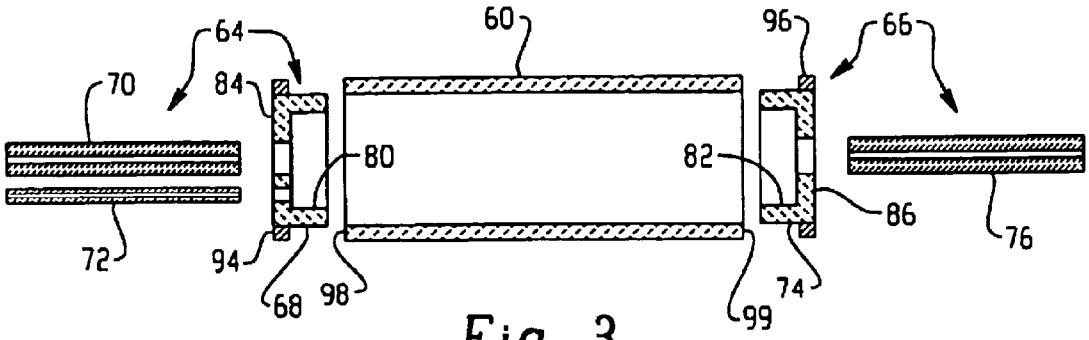
FIG. 3 is a side sectional view of the components of the discharge vessel of FIG. 2, prior to assembly.
Figure 4:
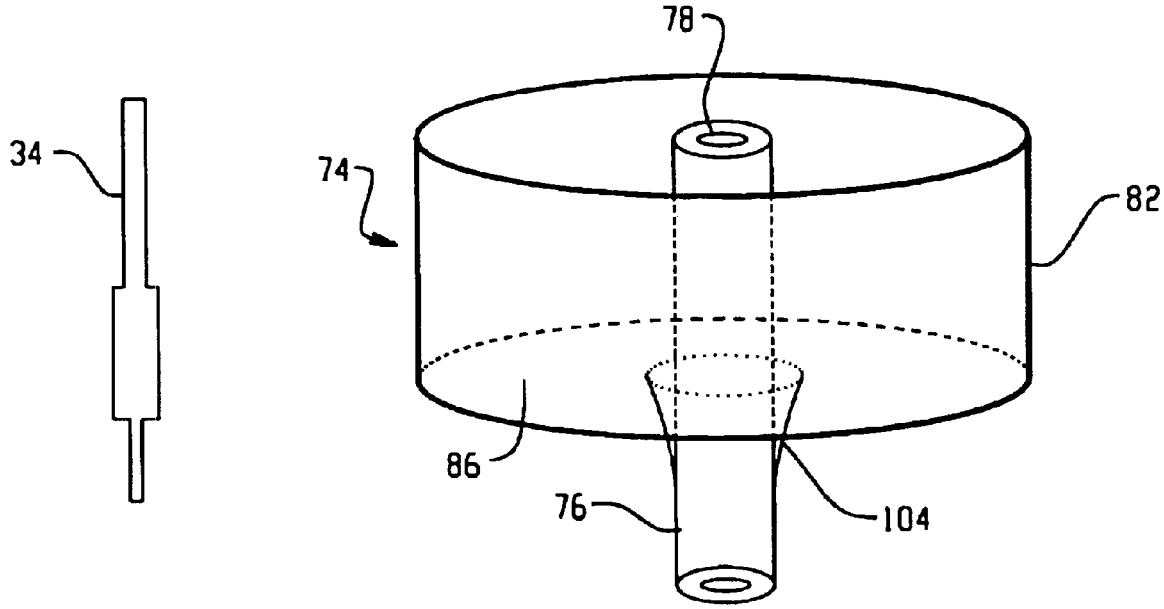
FIG. 4 is an enlarged perspective view of a single electrode end plug and electrode for the discharge vessel of FIG. 1.
Figure 5:
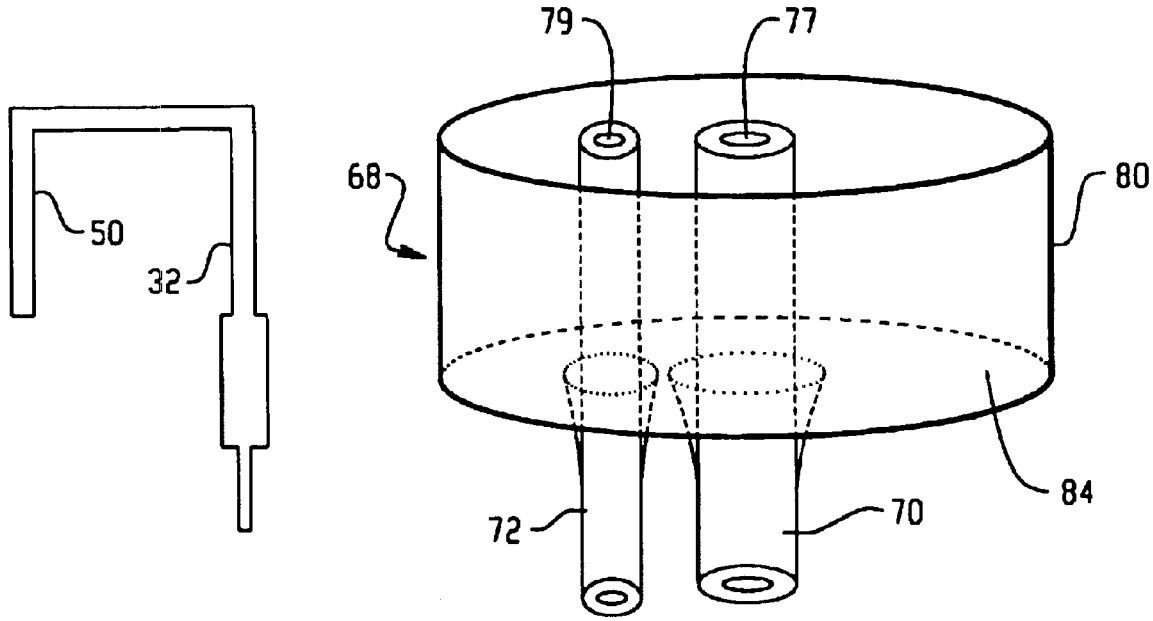
FIG. 5 is an enlarged perspective view of a dual electrode end plug and electrodes for the discharge vessel of FIG. 1.

With reference also to FIGS. 2 and 3, the ceramic arc tube 14 includes a hollow cylindrical portion or barrel 60 and two end plugs or caps 64, 66 The first end plug 64 includes a cylindrical base portion 68, from which two hollow leg portions or tubes 70, 72, extend outwardly. The second end plug 66 includes a cylindrical base portion 74 from which a third hollow leg portion or tube 76 extends outwardly. As shown in FIGS. 4 and 5 the leg portions carrying the main electrodes are slightly wider than the starter electrode leg. The first and second electrodes 32, 34 are typically located near opposite ends of the barrel 60. The third electrode is closely adjacent to the first electrode. The conductors 36, 38, 52 are disposed in bores 77, 78, 79 in the respective hollow leg portions 70, 76, 72 The discharge chamber 16 is sealed at the ends of the leg portions by seals to create a gas-tight discharge space.

Figure 6:
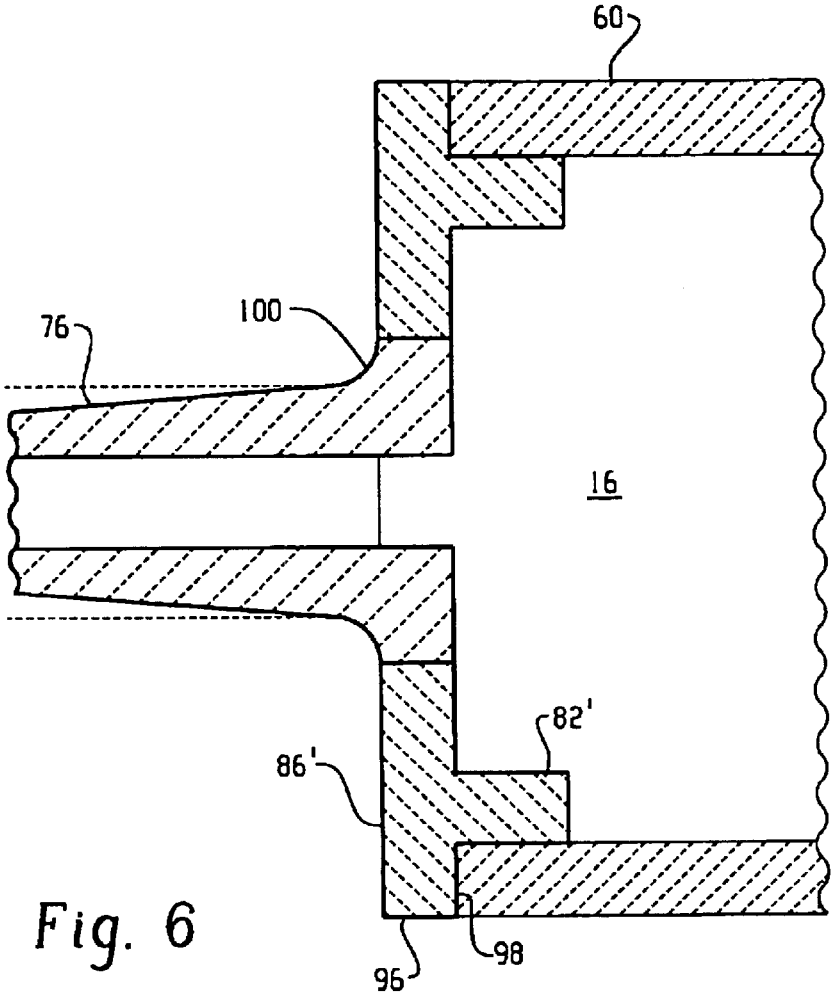
FIG. 6 is an enlarged sectional view of a portion of an alternative embodiment of the end plug of FIG. 5.

To reduce the risk of fracture during and after formation of the arc tube, the end plugs 64, 66 are provided with strengthening portions 80, 82. The strengthening portions take the form of an annular widened portion or skirt which extends from a generally circular top portion 84, 86 of the respective end plug in a direction opposite to the leg or legs. The skirt 80, 82 is received in the respective end of the barrel 60 to create an annular thickened region 90, 92 when the two parts are joined together (FIG. 2). While FIG. 2 shows the skirts extending in an annular ring adjacent the barrel, it is also contemplated that the skirt 80, 82 may form a solid cylinder, as shown in FIGS. 4 and 5, the legs aligning with corresponding bores 77, 78, 79 in the skirt. As shown in FIGS. 3 and 6, the skirt 80, 82 is spaced inwardly from the peripheral edge of the respective top portion 84, 86 by an annular rim portion or flange 94, 96. The flange is seated on a corresponding annular end 98, 99 of the barrel 60 when the arc tube is assembled.

In a preferred embodiment, shown in FIGS. 2 and 6, each of end plugs 64, 66 includes annular curved portions or fillets 100, 102, 104 between each of the leg portions 70, 72, 76 and the respective top 84, 86, which gives ends of the leg portions a contoured appearance. This avoids sharp corners between the legs and the top, which could otherwise contribute to fractures. The curved portions substantially increase the strength of the leg members and reduce the incidence of breakage in handling during assembly of the discharge vessel. The curved portions typically have a radius of curvature of about 1–3 millimeters. The adjacent leg portions may be tapered, as shown in FIG. 6.

The cylindrical portion 60 and end plugs 64, 66 are preferably all formed from a polycrystalline aluminum oxide ceramic, although other polycrystalline ceramic materials capable of withstanding high wall temperatures up to 1700–1900° C. and which are resistant to attack by the fill materials are also contemplated.

Figure 7:
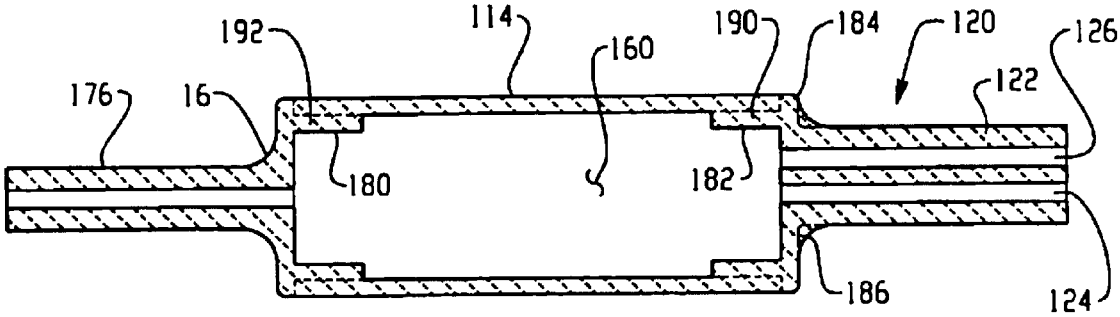
FIG. 7 is an alternative embodiment of a discharge vessel for the lamp of FIG. 1.

In another embodiment of an arc tube 114, shown in FIG. 7, the two-legged end plug 64, of the embodiments of FIGS. 1–6 is replaced with a single-legged end plug 120. The arc tube is otherwise similar to the arc tube 14 of FIG. 2. In this embodiment, the end plug 120 has a single leg 122 with two bores 124, 126, for receiving the first and third electrodes 32, 50, respectively (not illustrated). One bore 124 is concentric with the barrel and accommodates the leadthrough for the main electrode 32. The other bore 126 is off center to accommodate the lead through for the auxiliary starting electrode 50. The separation between the bores provides the separation between the electrodes This embodiment is easier to fabricate by injection molding than the embodiment of FIGS. 2 and 3. The double bored leg 122 is connected to the top 184 of the end plug 120 and preferably has an annular contoured filet 186 (outlined in phantom) between the leg and the top to reduce stresses. The arc tube 114 is otherwise similar to the arc tube 14, comprising a barrel 160 and a single bored end plug 176 Both end plugs preferably have skirts 180, 182 (outlined in phantom), which form thickened portions 190, 192 when the arc tube is assembled.

The ceramic arc tube may be formed form a single component or from multiple components. In a first embodiment, the arc tube 14, 114 is assembled from separate components. In the arc tube of FIG. 2, there are three main components, the two end plugs 64, 66 and the cylindrical portion 60, although fewer or greater numbers of components may be employed. The end plugs 64, 66 may be formed as single components (see FIG. 2) or may be separately assembled from the leg portions 70, 72, 76 and base portion 68, 74 as illustrated in FIG. 3. The arc tube 114 of FIG. 7 may also formed from three main components or the end plugs 120, 166 separately assembled from the leg portions 122, 176 and corresponding base portions.

The components are fabricated, for example, by die pressing, injection molding, or extruding a mixture of a ceramic powder and a binder system into a solid body. For die pressing, a mixture of about 95–98% of a ceramic powder and about 2–5% of a binder system is pressed into a solid body. For injection molding, larger quantities of binder are used, typically 40–55% by volume of binder and 60–45% by volume ceramic material.

The ceramic powder may comprise alumina having a purity of at least 99.98% and a surface area of about 2–10 $m^2/g$. The alumina powder may be doped with magnesia to inhibit grain growth, for example, in an amount equal to 0.03% to 0.2%, preferably, 0.05%, by weight of the alumina. Other ceramic materials which may be used include non-reactive refractory oxides and oxynitrides, such as yttrium oxide, lutecium oxide, and hafnium oxide, and their solid solutions and compounds with alumina, such as yttrium-aluminum-garnet and aluminum oxynitride. Binders which may be used for die pressing, either individually or in combination, include organic polymers, such as polyols, polyvinyl alcohols, vinyl acetates, acrylates, cellulosics, and polyesters. For injection molding, the binder may comprise a wax mixture or a polymer mixture.

For binders which are solid at room temperature, a thermoplastic molding process is preferably used. To carry out thermoplastic molding, sufficient heat and pressure is applied to the ceramic composition to force it to flow to the desired degree depending on the particular thermoplastic molding process employed. The ceramic powder/binder composition is heated to a temperature at which the binder is soft or molten. For most commercial thermoplastic forming techniques, the ceramic composition is heated to make the binder molten at from about 60° C. to about 200° C., shaped under a pressure ranging from about 0.35 $kg/cm^2$ to about 2,100 $kg/cm^2$, depending upon the particular thermoplastic forming technique, and then allowed to cool and harden. For example, in the case of injection molding, the molten ceramic composition is forced into a die to produce the molded product. Specifically, for injection molding, the molten ceramic mixture, preferably at a temperature from about 65° C. to about 90° C. and under a pressure ranging from about 70 $kg/cm^2$ to about 2,100 $kg/cm^2$, is forced into a die where it is allowed to harden and then removed from the die. The die may be cooled to facilitate hardening. A number of thermoplastic molding techniques can be used to produce the present molded body. Representative of such techniques are pressure injection molding, gas-assisted injection molding, extrusion molding, blow molding, compression molding, transfer molding, drawing and rolling.

Figure 8:
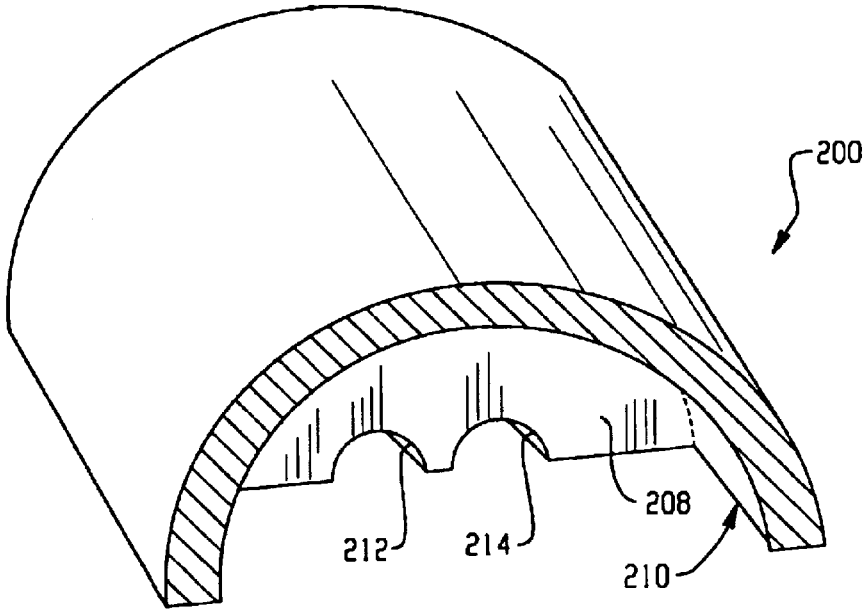
FIG. 8 is a sectional view of a mold half for forming a unitary arc tube body, according to the present invention.

Other binders, such as aqueous binders, do not need to be heated to form a slurry suitable for molding. For example, as illustrated in FIG. 8, in one single piece molding technique, a mold formed from Plaster of Paris is formed in two halves. Only one half 200 is shown in FIG. 8, sectioned roughly midway along the part so that a portion of a mold cavity 208, comprising a barrel portion 210, and two leg portions 212, and 214, extending from the barrel portion, is visible. It will be appreciated that the other end of the mold half (not shown) has a single leg portion. The corresponding second mold half is analogously formed, such that when the two mold halves are mated together, the barrel portions and the leg portions are aligned. A slurry formed from a mixture of a ceramic powder (e.g., alumina/magnesia, as described above) and a liquid, such as water, is poured into the mold. The mold is rotated to distribute the slurry over internal surfaces of the mold cavity. Since the Plaster of Paris is absorbent, the water is quickly drawn out of the slurry, leaving a coating of ceramic powder on the internal walls. When dry, the mold halves can be removed leaving the arc tube ready for further drying, sintering, firing, and other processing.

Subsequent to die pressing, injection molding, single piece molding, or other forming technique, the binder is removed from the "green" part For example, for die pressed parts, the binder is removed by solvent leaching with hexane, and/or by thermal pyrolysis to form a bisque-fired part. The thermal pyrolysis may be conducted, for example, by heating the green part in air from room temperature to a maximum temperature of about 900–1100° C. over 4–8 hours, preferably, to a temperature of about 200–400° C., and then holding the maximum temperature for 1–5 hours, and then cooling the part. After the thermal pyrolysis, the porosity of the bisque-fired part is about 40–50%. Pyrolysis generally oxidizes and burns out the volatile components.

For injection-molded parts, the binder is removed from the molded part, typically by thermal treatment. The thermal treatment may be conducted by heating the molded part in air or a controlled environment, e.g., vacuum, nitrogen, or rare gas, to a maximum temperature. For example, the temperature may be slowly increased by about 2–3° C. per hour from room temperature to a temperature of about 160° C. Next, the temperature is increased by about 100° C. per hour to a maximum temperature of about 900–1100° C. Finally, the temperature is held at 900–1100° C. for about 1–5 hours. The part is subsequently cooled. After the thermal treatment step, the porosity is about 40–50%.

The bisque-fired part is then machined, where needed For example, a small bore or bores may be drilled along the axis of a solid cylinder to provide the bore(s) of the leg portion. The outer portion of the solid cylinder may be machined away, for example with a lathe, to form the outer surface of the leg portion 70, 72, 76, curved filet 100, and flange 94. The machined parts are typically assembled prior to sintering to allow the sintering step to bond the parts together. The densities of the bisque fired parts used to form the barrel and the end plugs is preferably selected to achieve different degrees of shrinkage during the sintering step The different densities may be achieved by using ceramic powders of different surface areas. Finer powders produce lower densities than coarser ones The barrel is preferably of lower density than the end plug so that it shrinks more.

Figure 9:
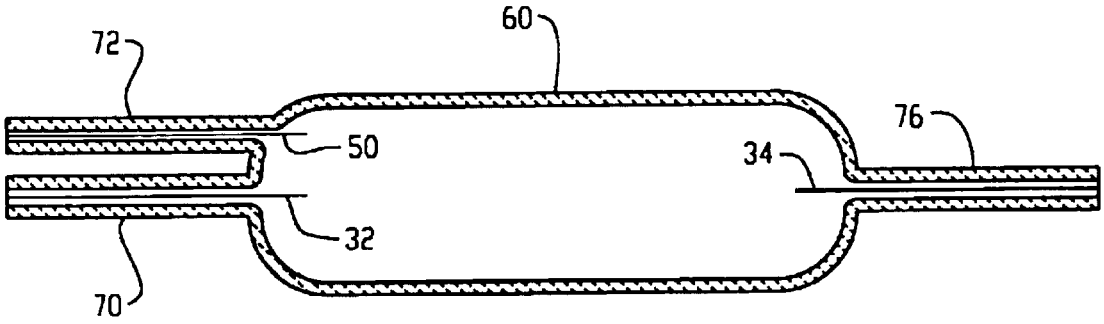
FIG. 9 is a side sectional view of an arc tube formed using the mold of FIG. 8.

For arc tubes formed by a single piece molding technique, as described above, there are not the same density concerns discussed above, since the green part is a single component, rather than separate components which are joined in the sintering stage. Further, if the size and shape of the mold is carefully selected, machining of the bisque-fired part may not be necessary, since the mold can be used to define the outer surface, including filets and the internal bores. It will be appreciated, however, that this method yields a barrel of generally uniform wall thickness. The thickened portions 90, 92 shown in FIG. 2 are not readily formed by this method. However, because of the unitary construction, the transition from the barrel to the end plug is naturally stronger than an equivalent arc tube formed from separate components and tends naturally to have a curved profile, which reduces stresses (see FIG. 9).

The sintering step may be carried out by heating the bisque-fired parts or arc tube in hydrogen having a dew point of about 10–15° C. or in an inert atmosphere. Argon gas provides a suitable inert atmosphere, although other inert gases are also contemplated. Typically, the temperature is increased from room temperature to about 1300° C. over a two hour period. Next, the temperature is held at about 1300° C. for about two hours. The temperature is then increased by about 100° C. per hour up to a maximum temperature of about 1850–1900° C., and held at that temperature for about three to five hours. Finally, the temperature is decreased to room temperature over about two hours. The inclusion of magnesia in the ceramic powder typically inhibits the grain size from growing larger than 75 microns. The resulting ceramic material comprises a densely sintered, polycrystalline alumina.

Pressures above atmospheric may also be applied during the sintering step. The bisque-fired ceramic is converted, during sintering, from an opaque material to a translucent polycrystalline aluminum oxide. The sintering step also strengthens the joints between the components of the arc tube. Other sintering methods are also contemplated.

The sinterable ceramic powder preferably has an average particle size of from 0.01–1000 $\mu$m, more preferably, below about 50 $\mu$m. For arc tube applications, the average size of the ceramic powder preferably ranges up to about 10 $\mu$m and depends largely on the particular densification technique employed, i.e, larger particle sizes can be used in reaction bonding whereas smaller particle sizes would be used in sintering a compact thereof. Preferably, however, the ceramic powder has an average particle size which is submicron and most preferably, it has an average particle size ranging from about 0.05 microns up to about 1 micron.

Figure 10:
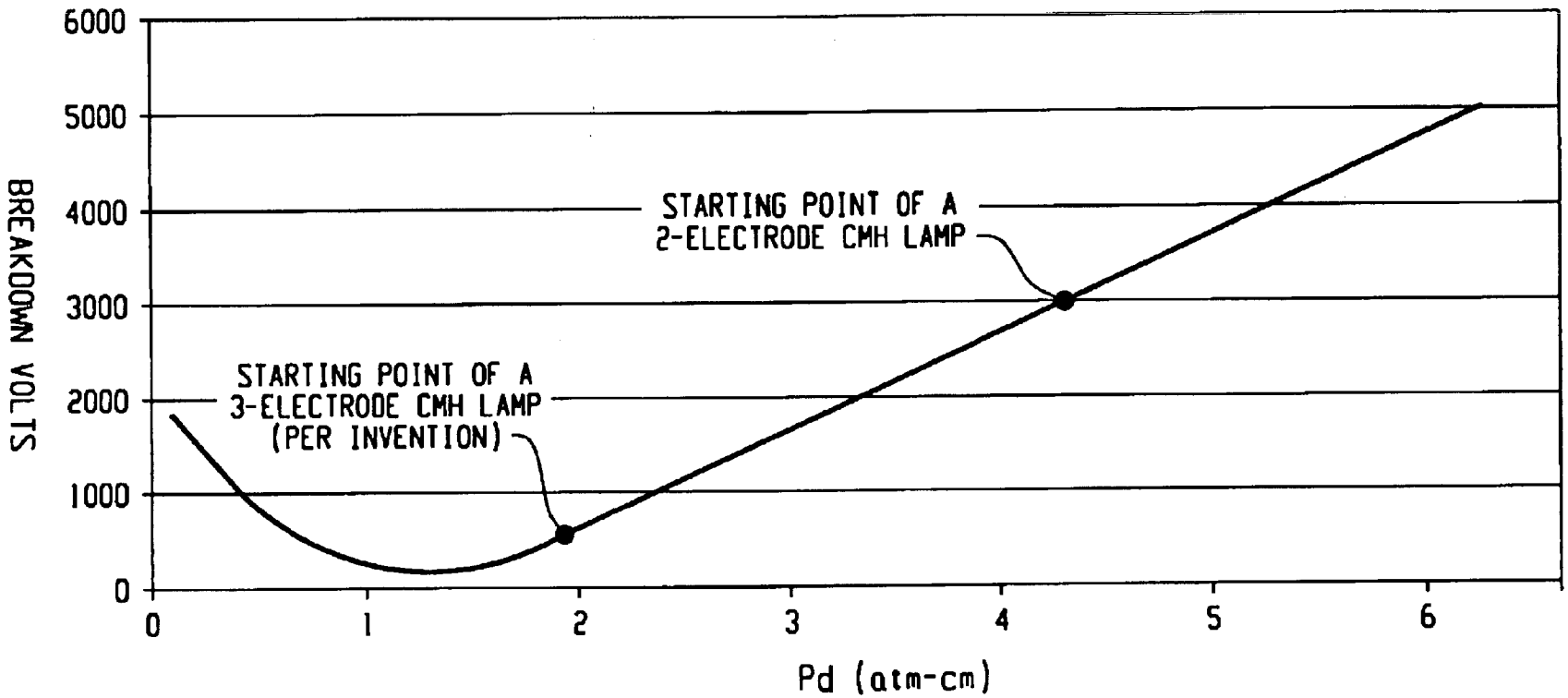
FIG. 10 is a plot of breakdown voltage versus fill pressure times distance between electrodes for an exemplary ceramic metal halide fill

FIG. 10 shows a plot of breakdown voltage vs pxd for an exemplary metal halide fill comprising sodium iodide and argon gas, where p is the pressure of the fill in atmospheres and d is the distance between the two electrodes initiating the discharge. Two electrode discharge vessels typically have a pxd of 4–5, and a corresponding breakdown voltage of about 3000 volts. The exact breakdown voltage also depends on the nature of the fill gas (i.e., Argon, Krypton, or the like). A three electrode discharge vessel of the present invention may be formed with a much lower pxd, because of the closer spacing of the electrodes initiating the discharge Consequently, the breakdown voltage is much lower, generally below 1000 volts, and most preferably, about 500 volts.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof

What is claimed is:

1. A discharge vessel comprising:

a body of a translucent ceramic material, the body including:

a barrel portion, first and second end walls closing ends of the barrel portion to define an interior chamber, at least a first generally cylindrical tube extending from the first end wall and opening into the chamber, and a second generally cylindrical tube extending from the second end wall and opening into the chamber, the first cylindrical tube and the second cylindrical tube each having a shoulder portion which provides a curved transition between the cylindrical tube and the end wall;

a fill contained in the body for creating a discharge;

electrodes supported in the chamber, the electrodes including:

a first main electrode, a second main electrode, and an initiator electrode disposed a preselected distance from the first electrode, the first main electrode and the initiator electrode being electrically connected with first and second lead through disposed in the at least a first cylindrical tube, the second main electrode being connected with a third lead through disposed in the second cylindrical tube.

2. The discharge vessel of claim 1, wherein each of the end walls is formed with an annular skirt which is joined to the barrel portion during formation of the discharge vessel to provide an annular widened portion at each end of the barrel portion.

3. The discharge vessel of claim 1, wherein the at least a first generally cylindrical tube includes a first generally cylindrical tube which receives the first lead through and a second generally cylindrical tube which receives the second lead through.

4. The discharge vessel of claim 1, wherein the at least a first generally cylindrical tube includes first and second bores extending therethrough.

5. The discharge vessel of claim 1, wherein the shoulder has a radius of curvature of about 1–3 mm.

6. The discharge vessel of claim 1, wherein the fill includes a metal halide.

7. The discharge vessel of claim 1, wherein the body is formed from a polycrystalline alumina.

8. The discharge vessel of claim 1, wherein the first main electrode and the initiator electrode are spaced by a distance of about 1–2 mm.

9. The discharge vessel of claim 1, wherein the fill has a breakdown voltage of less than 1000 volts.

* * * * *